United States Patent [19]

Selbiger

[11] Patent Number: 4,817,303

[45] Date of Patent: Apr. 4, 1989

[54] ATHLETIC SHOE HAVING A DUAL SIDE LACING SYSTEM

[75] Inventor: Lawrence Selbiger, Portland, Oreg.

[73] Assignee: AVIA Group International, Inc., Portland, Oreg.

[21] Appl. No.: 74,651

[22] Filed: Jul. 17, 1987

[51] Int. Cl.[4] ..... A43B 11/00

[52] U.S. Cl. ..... 36/50; 36/51

[58] Field of Search ..... 36/50, 51, 114, 45; 24/140, 141

[56] References Cited

U.S. PATENT DOCUMENTS

| | | | |
|---|---|---|---|
| 116,653 | 7/1871 | Webb | 36/50 |
| 157,972 | 12/1874 | Pruett | 36/50 |
| Des. 195,817 | 8/1963 | Tronche | D7/7 |
| 198,134 | 11/1877 | McDonald | 36/50 |
| 354,555 | 12/1886 | Banister | 36/50 |
| 697,590 | 4/1902 | Wright | 36/51 |
| 716,528 | 12/1902 | Flowers | 36/50 |
| 901,353 | 10/1908 | Lafond | 36/50 |
| 1,412,486 | 4/1922 | Paine | 36/50 |
| 1,434,723 | 11/1922 | Triay, Jr. | 24/140 |
| 1,526,690 | 2/1925 | Anderson | 36/50 |
| 2,311,996 | 2/1943 | Parker | 36/51 |
| 3,169,325 | 2/1965 | Fesl | 36/2.5 |
| 4,394,803 | 7/1983 | Goldstein | 36/50 |
| 4,553,342 | 11/1985 | Derderian et al. | 36/50 |
| 4,616,432 | 10/1986 | Bunch et al. | 36/50 |
| 4,617,746 | 10/1986 | Hannah | 36/133 |
| 4,638,576 | 1/1987 | Parracho et al. | 36/68 |
| 4,670,998 | 6/1987 | Pasternak | 36/114 |
| 4,676,011 | 6/1987 | O'Rourke et al. | 36/50 |

FOREIGN PATENT DOCUMENTS

| | | | |
|---|---|---|---|
| 6801 | 1/1902 | Austria | 36/51 |
| 223053 | 6/1910 | Fed. Rep. of Germany . | |
| 2536964 | 6/1984 | France | 36/50 |
| 464 | of 1855 | United Kingdom | 36/51 |
| 26527 | of 1914 | United Kingdom . | |
| 133871 | 6/1919 | United Kingdom | 36/50 |

*Primary Examiner*—Steven N. Meyers

*Attorney, Agent, or Firm*—Saidman, Sterne, Kessler & Goldstein

[57] ABSTRACT

An athletic shoe is provided which has lateral and medial quarter panels which are each made of a non-stretchable panel and an elastic panel. A lacing system is provided using a single shoelace. The athletic shoe may also include wrap-around eyestays.

10 Claims, 5 Drawing Sheets

ATHLETIC SHOE HAVING A DUAL SIDE LACING SYSTEM

BACKGROUND OF THE INVENTION

1. Field of the Invention

This invention relates generally to athletic shoes, and more particularly to a lacing method and system for use in a running shoe.

2. Description of Related Art

One of the problems with athletic shoes on the market today is that there is significant pressure generated on the top of the foot of the user due to conventional lacing. Most shoes have a row of eyelets, one on the medial side of the shoe and one on the lateral side of the shoe. A lace is then strung back and forth in any conventional manner to tighten the shoe. This creates substantial stresses on the top of the forefoot portion of the foot. One attempt to solve this problem is described in U.S. Pat. No. 4,553,342 issued to Derderian et al., which discloses an athletic shoe with an adjustable width, adjustable tension closure system which attempts to relieve stresses on the top of the foot by enabling the user to vary the stresses created at different portions of the foot.

One patent of interest which appears to show a quick lacing athletic shoe is the French Demande de Brevet D'invention No. 2,565,795, which teaches an athletic shoe which utilizes a plurality of D-shaped eyelets. A single side of a lace is strung between the eyelets and is secured by a slot on a retaining device. Although this patent appears to provide a quick lacing shoe, it does not address the problem of localized stresses in the foot, and appears to have the same stresses as associated with a conventional athletic shoe. Shoes and particularly athletic shoes need to be both functional and comfortable in order to fulfill the needs of a wearer. Previous patents have failed to adequately address the problem of localized pressure on the top of the foot.

An object of the invention is to provide an athletic shoe which minimizes stresses in the forefoot portion of the shoe, and redistributes the stresses to eliminate unnecessary stress in the foot.

Another object of the invention is to provide a shoe which is easy to put on and fits snugly about the foot of the user. It is another object of the invention to provide a shoe which allows a broad range of tightening about the foot and provides a quick lacing athletic shoe which maintains tension even when untied.

SUMMARY OF THE INVENTION

To achieve the foregoing and other objects, and in accordance with the purposes of the present invention, as embodied and broadly described herein, the upper for an athletic shoe of the present invention has a toe portion, a lateral quarter panel having a lower edge attached to a shoe sole, and an upper edge. The upper also has a medial quarter panel which has a lower edge attached to a shoe sole and has an upper edge. The lateral quarter panel includes a first non-stretchable panel and a first elastic panel and the medial quarter panel includes a second non-stretchable panel and a second elastic panel. The upper also includes a vamp which substantially covers and protects the forefoot and extends from the toe portion in the direction of the user's ankle. The vamp has a lateral side and a medial side; the lateral side of the vamp is attached to the upper edge of the lateral quarter panel and the medial side is attached to the upper edge of the medial quarter panel. The upper also has a means for lacing the lateral side of the shoe which has at least one eyelet connected to the lateral side of the vamp and at least one eyelet connected to the lateral quarter panel. Similarly, the medial side of the shoe has a lacing means which includes at least one eyelet connected to the medial side of the vamp and at least one eyelet connected to the medial quarter panel. The means for lacing the lateral side of the shoe and the means for lacing the medial side of the shoe are oriented so that both of these means for lacing can be laced utilizing a single shoe lace.

In another aspect of the invention, a first and second wrap-around eyestay is utilized which has at least one eyelet and is arranged to be laced in a conventional manner after the shoe lace has been laced through the means for lacing the lateral and medial sides of the shoe. The first wrap-around eyestay extends from the lateral side of the shoe and the second wrap-around eyestay extends from the medial side of the shoe member so that the first and second wrap-around eyestays secure the ankle of a foot when laced.

In yet another aspect of the invention, there is a tongue member which extends from the vamp in a direction away from the toe portion.

In another aspect of the invention, the first and second wrap-around eyestays are effective to fold at least partially over the tongue member and fold in a direction toward each other. The wrap-around eyestays may also include eyelets for securing a shoelace. Tear-shaped eyelets may be used in the wrap-around eyestays. These eyelets may be oriented so that the shoelace is positioned within the small portion of the teardrop, to secure the shoelace and prevent movement of the shoelace through the eyelet.

In another aspect of the invention, an upper for an athletic shoe is provided which includes a first non-stretchable panel, a second non-stretchable panel and a vamp member. The vamp has a medial side and a lateral side and is disposed between and separated from the first non-stretchable panel and the second non-stretchable panel. Also provided is a means for biasing the first non-stretchable panel toward the vamp member and means for biasing the second non-stretchable panel toward the vamp member when a foot is positioned in the shoe.

In another aspect of the invention, an athletic shoe is provided which has an outsole and an upper. The upper has a vamp which is disposed substantially on the top of the upper and elastic means disposed between both sides of the vamp and the outsole. The athletic shoe may also have a means for adjusting the tension imparted by the elastic means which may include a lacing means disposed across the vamp and along the elastic means so that when the lacing means is tightened the tension imparted by the elastic means is reduced.

Another aspect of the invention is to provide elastic panels as the biasing means. In one aspect of the invention, means for selectively increasing the magnitude of the biasing force. This can be done using lacing.

One advantage of the present invention is that by utilizing elastic panels which are oriented between the eyelets, the lace may be snugly tightened to the foot without having large localized stresses which may cause discomfort.

Another advantage of the invention is that the wrap-around eyestays provide a large opening for positioning of the foot within the shoe. This solves the problem of having to force the foot into the shoe.

Yet another advantage of the present invention is that the shoe may be quickly laced, and the teardrop orientation of the eyelets in the wrap-around eyestays secure the lace in position.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE PREFERRED EMBODIMENTS

Figure 1:
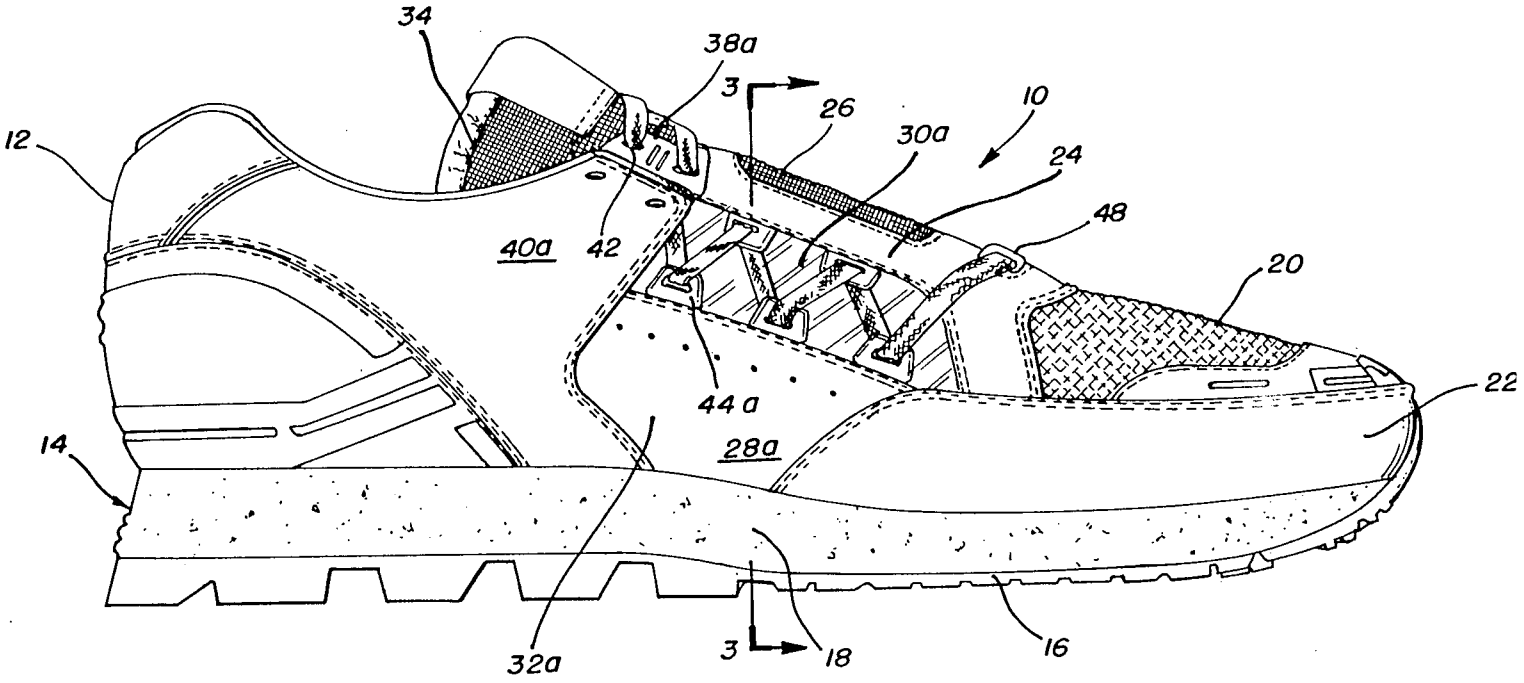
FIG. 1 is a side elevation view of an athletic shoe in accordance with one embodiment of the invention.

Referring to the accompanying drawings, FIG. 1 is a side elevation view of an athletic shoe in accordance with one embodiment of the invention.

The shoe of the present invention, designated generally as 10, has an upper 12 which is attached in a conventional manner to sole 14. Sole 14 includes an outsole 16 which makes contact with the ground and serves the purpose of providing traction, and a midsole 18 which is typically the portion of the shoe which provides most of the cushioning. Any conventional sole may be used to practice the invention.

The upper 12 of the shoe 10 has a toe portion 20 which extends from toe foxing 22 to substantially cover the toes of a person wearing the athletic shoe of the present invention. The vamp 24, that part of the shoe which covers the forefoot, extends from the toe portion 20 along the top of the foot. The center of vamp 24 is provided with a cushioning panel 26. It should be noted that there is no specific boundary which divides the toe portion 20 and the vamp 24, but rather, the vamp 24 and the toe portion 20 together cover substantially the entire top of a wearer's foot.

The upper has a lateral quarter panel **28*a* disposed between the midsole 18 and the vamp 26 which is preferably made up of two distinct panels. These panels include a first elastic panel 30*a* and a first non-stretchable panel 32*a*. In a preferred embodiment, the first non-stretchable panel 32*a*** is made of a material such as leather and extends from the midsole upwardly in the direction of the vamp. It is important to note that the term "non-stretchable" does not mean to imply that the material making up this panel is totally inelastic. It simply means that this panel is not designed to stretch. Any slight stretching of this panel does not affect the function of the invention.

Figure 2:
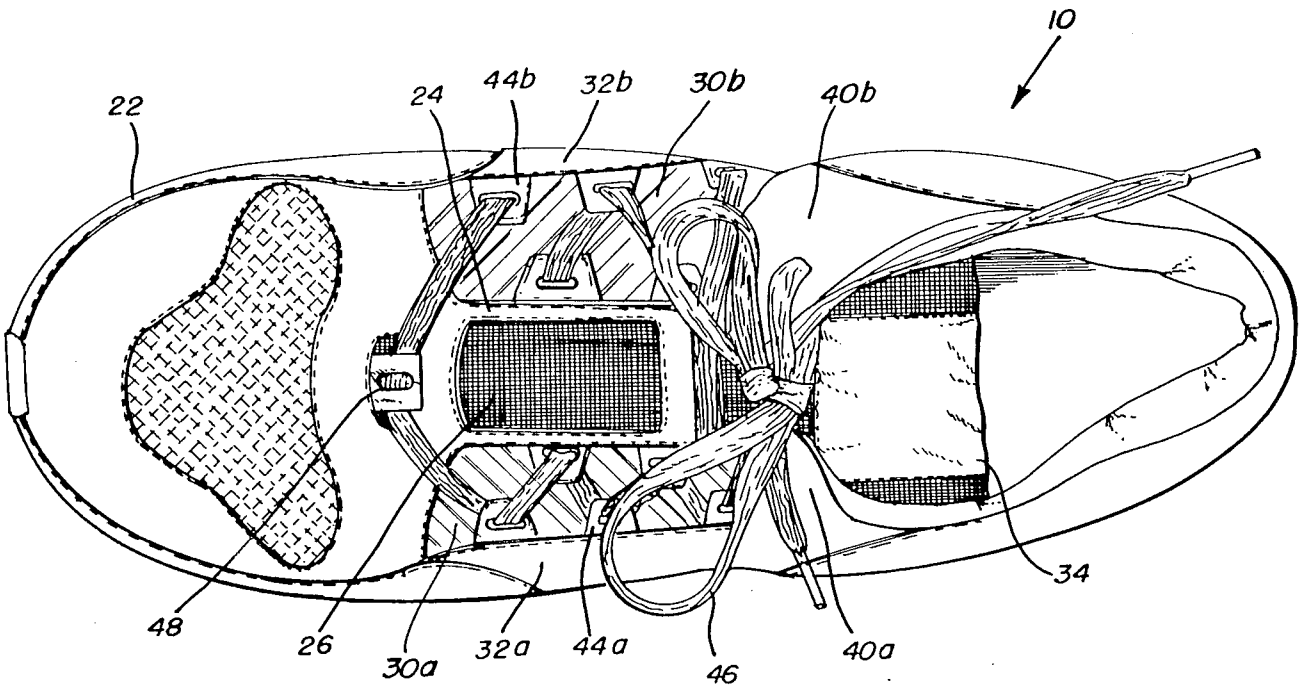
FIG. 2 is a top view of an athletic shoe in accordance with the invention.
Figure 3:
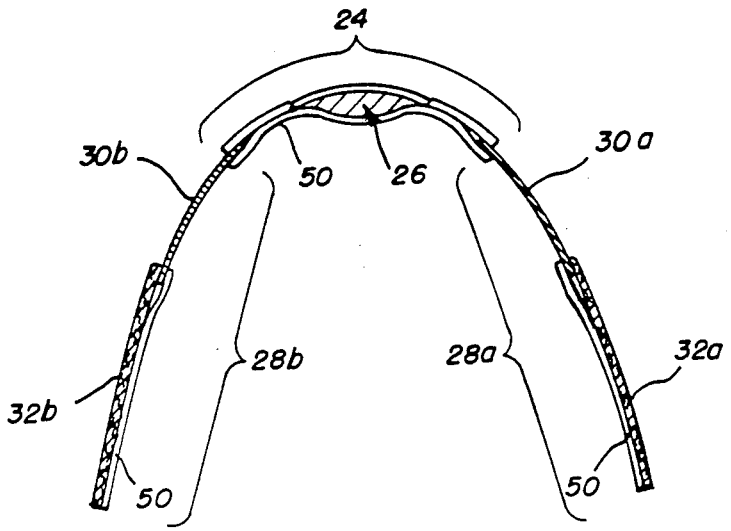
FIG. 3 is a simplified cross-section of the shoe shown in FIG. 1 cut generally along lines 3—3 without showing any eyelets.

Attached to the top of the first non-stretchable panel **32*a* is the first elastic panel 30*a* which is connected to vamp 24. The medial side of the shoe has a similar construction as shown in FIGS. 2 and 3. The medial side of the shoe has a medial quarter panel 28*b* which is made up of a second non-stretchable panel 32*b* and a second elastic panel 30*b*. Although there are a number of possible techniques for constructing this shoe, in a preferred embodiment of the invention the first elastic panel 30*a* and the first non-stretchable panel 32*a* are stitched together to form a lateral quarter panel 28*a*. Similarly, the second elastic panel 30*b* and the second non-stretchable panel 32*b* are stitched together to form the medial quarter panel 28*b*. The lateral quarter panel 28*a* is stitched to the lateral side of the vamp 24 and the medial quarter panel is stitched to the medial side of vamp 24. This construction is best since in FIG. 3 which is a view of FIG. 1 cut along line 3—3. A lining material 50 may also be incorporated into the interior of the shoe as shown in FIG. 3**.

The sizes of the first elastic panel **30*a* and second elastic panel 30*b* are chosen so that they are generally stretched, at least slightly, when a foot is positioned in the shoe 10**. The elastic members themselves, because they are so biased, provide a snug fit independent of the lacing system which will be described later in this specification.

Figure 4:
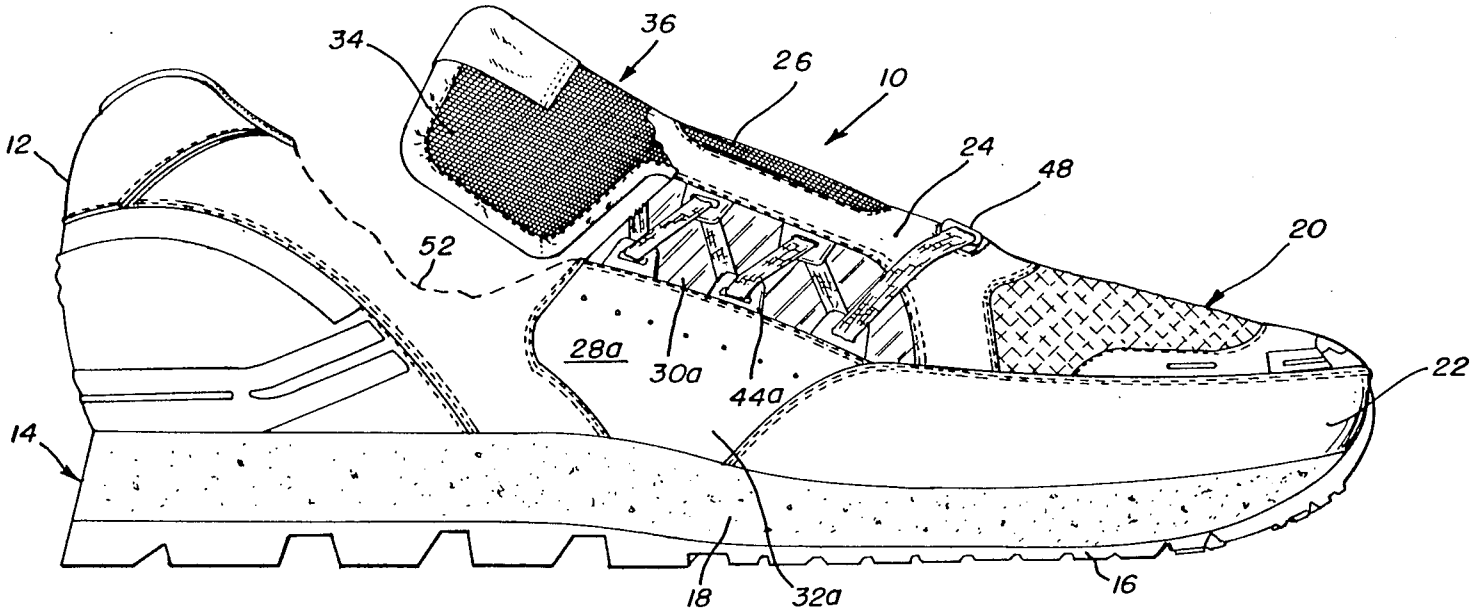
FIG. 4 is a partial cut away side elevation view of an athletic shoe in accordance with one embodiment of the invention.

FIG. 4 shows a cut away view which exposes the tongue 34 of the shoe 10. As shown in this figure, tongue 34 extends rearwardly and laterally from vamp 24. Although there are many different possible shapes for the tongue, in a preferred embodiment the tongue has a width which is generally greater than that of vamp 24. In a preferred embodiment of the invention, tongue 34 is integrally formed with vamp 24 and extends therefrom so as to form a T-shape therewith. The position at which the vamp 24 ends and the tongue 34 begins is designated generally at arrow 36. Because of the way the tongue is constructed, the tongue can be pivoted at point 36, thereby providing a large opening for insertion of a foot within the shoe 10.

Turning now to the lacing system which is utilized in accordance with the present invention, there are a number of lacing components which will be described in turn. These lacing components are best seen in FIGS. 1, 2 and 4. A shoe lace guide 48 is positioned along the longitudinal axis of the shoe and at a point near the bottom of vamp 24.

A plurality of lateral side D-ring eyelets **44*a* are disposed on the upper edge of first non-stretchable panel 32*a* and on the lateral side of vamp 24. In a preferred embodiment of the invention, these D-ring eyelets 44*a* are oriented so that a lace going through the eyelets will form a general zigzag pattern. The medial side of the shoe includes medial D-ring eyelets 44*b* as shown in FIG. 2**.

Figure 5:
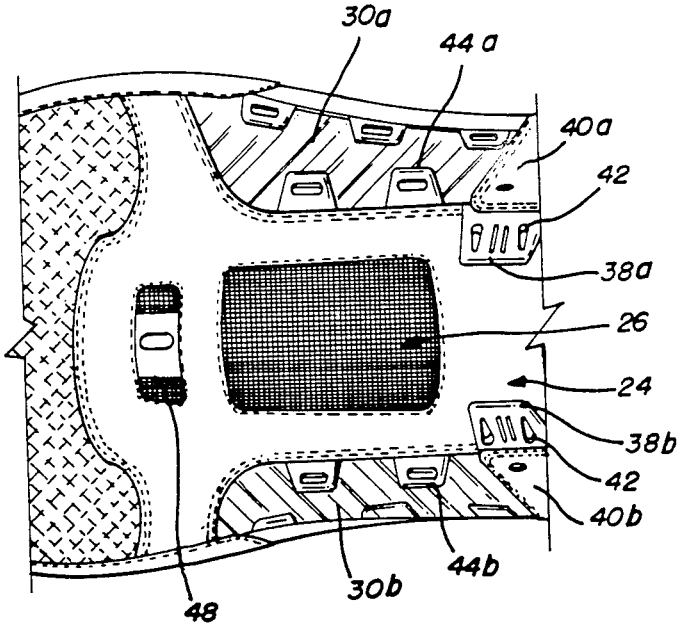
FIG. 5 is a partial top plan view of the shoe shown in FIG. 1.

Another preferred lacing component, best viewed in FIG. 5, includes a lateral side eyelet retaining member **38*a* and a medial side eyelet retaining member 38*b*. Tear-shaped eyelets 42 are provided in both the lateral side eyelet retaining member 38*a* and the medial side eyelet retaining member 38*b*. The lateral and medial side eyelet retaining members 38*a* and 38*b* are disposed on wrap-around eyestay arms 40*a* and 40*b*. These eyelet retaining members 38*a* and 38*b* are attached to the main body of shoe 10 at a point roughly the same as the dotted line 52 in FIG. 4. FIG. 4, however, does not show the wrap-around eyestay arms. They can, however, be seen in both FIGS. 1 and 2. In this way, the wrap-around eyestay arms 38*a* and 38*b*** provide a custom fit to the wearer of the shoe. The foot of the user may easily be positioned within the shoe without difficulty because the eyestays may be moved away from the main body of the shoe. The wrap-around eyestays may then be wrapped around the ankle of the user to provide a better fit.

A lace 46 may be used to supplement the snug fit inherently provided by elastic panels 30*a* and 30*b*. As previously mentioned, the elastic panels 30*a* and 30*b* provide a biasing force which tends to pull the first and second non-stretchable panels 32*a* and 32*b* toward the vamp 24. The lacing system of the invention allows the user to provide a tighter fit of the shoe, without producing unwanted binding forces on the top of the foot. To lace the shoe, a single shoelace is positioned through shoelace guide 48 so that equal lengths of a shoelace 46 are on each side of the lacing guide. One side of the shoelace is laced through D-ring eyelets 44*a* while the other side of the shoelace is laced through D-ring eyelets 44*b*. In the embodiment of the invention shown in FIGS. 2 and 5 there are five D-ring eyelets 44*a* on the lateral side of the shoe, and five D-ring eyelets 44*b* on the medial side of the shoe. Three of the eyelets 44*a* are attached to the first non-stretchable panel 32*a* and two of the D-ring eyelets 44*a* are attached to the vamp 24. These D-ring eyelets are positioned to extend partway over the first elastic panel 30*a*. The medial side of the shoe has a similar orientation for the medial D-ring eyelets 44*b*. After shoelace 46 has been strung or laced through the D-ring eyelets 44*a* and 44*b*, the side of lace 46 which was used to lace the lateral side of the shoe is extended to the lowermost eyelet 42 in the medial side eyelet retaining member 38*b*. Similarly, the side of lace 46 which was used to lace the medial D-ring eyelets 44*b* is extended toward the lateral side eyelet retaining member 38*a* and laced through an eyelet positioned therein. The lace may then be strung through the remaining eyelets 42 in a conventional manner and tied as shown in FIG. 2. The lace 46, when tensioned, urges the non-stretchable panel 42*a* toward vamp 24 and the second non-stretchable panel 32*b* toward the vamp 24. This supplements the snug fit already provided by the first elastic panel 30*a* and the second elastic panel 30*b*. In a preferred embodiment of the invention, the first elastic panel 30*a* and the second elastic panel 30*b* are preferably sized so that they will not severely buckle upon lacing in the manner described above.

FIG. 5 is a top view of the eyelet components without a lace running therethrough. In the embodiment of the invention shown in FIG. 5, the eyelets 42 which are positioned in the eyelet retaining members 38*a* and 38*b* are teardrop-shaped. As seen in these figures, the eyelets have a wide side which allows easy pull-through of a lace, and a narrow side which will lock the lace in place when located and tensioned therein (see FIG. 1).

The foregoing description of the preferred embodiment of the invention has been presented for purposes of illustration and description. It is not intended to be exhaustive or to limit the invention to the precise form disclosed, and obviously many modifications and variations are possible in light of the above teachings. For example, it is possible that more or less eyelets may be used in each component of the lacing system. In addition, it may be possible to have eyelets which are shaped significantly different than the D-ring eyelets shown in the drawings. Similarly, the wraparound eyestay shown in the accompanying drawings may take on a number of different forms and may be provided at a different angle than specifically shown in the drawings. Further still, it is possible to first lace the shoe in a conventional manner near the toe portion of the shoe and then to relieve the tension in the foot by utilizing the invention. The embodiments were chosen and described in order to best explain the principles of the present invention and its practical application to thereby enable others skilled in the art to best utilize the invention in various embodiments and with various modifications as are suited to the particular use contemplated. It is intended that the scope of the invention be defined by the claims appended hereto.

I claim:

1. An upper for an athletic shoe, comprising:

a. a toe portion;

b. a lateral quarter panel having a lower edge attached to a shoe sole and having an upper edge, said lateral quarter panel having a first non-stretchable panel and a first elastic panel;

c. a medial quarter panel having a lower edge attached to a shoe sole and having an upper edge, said medial quarter panel having a second non-stretchable panel and a second elastic panel;

d. a vamp for substantially covering and protecting a forefoot and extending from said toe portion, said vamp having a lateral side and a medial side, said lateral side of said vamp being attached to the upper edge of said lateral quarter panel and said medial side of said vamp being attached to the upper edge of said medial quarter panel;

e. means for lacing the lateral side of the shoe comprising at least one eyelet connected to the lateral side of said vamp and at least one eyelet connected to said lateral quarter panel; and f. means for lacing the medial side of the shoe comprising at least one eyelet connected to the medial side of said vamp and at least one eyelet connected to said medial quarter panel; said means for lacing the lateral side of the shoe and means for lacing the medial side of the shoe being oriented so that both said means can be laced with a single lace.

2. The upper of claim 1, further comprising a tongue member which extends from the vamp in a direction away from said toe portion.

3. The upper of claim 1, further comprising a first and a second wrap-around eyestay each having at least one eyelet and being arranged to be laced in a conventional manner after a shoe lace has been laced through said means for lacing the lateral side of the shoe and means for lacing the medial side of the shoe.

4. The upper of claim 2, wherein said first and second wrap-around eyestays are effective to fold at least partially over said tongue member in a direction toward each other.

5. The upper of claim 4, wherein said first wrap-around eyestay further comprises an eyelet having means for securing a shoe lace.

6. The upper of claim 4, wherein said second wrap-around eyestay comprises an eyelet having means for securing a shoe lace.

7. The upper of claim 4, wherein said first wrap-around eyestay defines a tear-shaped eyelet, said tear-shaped eyelet being oriented to receive a shoelace and selectively prevent the shoelace from moving through said eyelet.

8. An athletic shoe comprising:

(a) an outsole; and (b) an upper, having a vamp having medial and lateral sides disposed on the top thereof and elastic means disposed between both medial and lateral sides of said vamp and said outsole, said upper having a tension adjusting means for adjusting the tension imparted by said elastic means, wherein said tension adjusting means comprises a lacing means disposed across said vamp and along said elastic means so that when said lacing means is tightened, the tension imparted by said elastic means is reduced.

9. The athletic shoe of claim 8, further comprising a tongue member which extends from said vamp.

10. The athletic shoe of claim 9, further comprising first and second wrap-around eyestays arranged to fold towards each other at least partially over said tongue member.

* * * * *